US008360339B2

(12) United States Patent
Henry

(10) Patent No.: US 8,360,339 B2
(45) Date of Patent: Jan. 29, 2013

(54) FIRE SUPPRESSION APPARATUS AND METHOD FOR GENERATING FOAM

(75) Inventor: Darren Sean Henry, Williamston, SC (US)

(73) Assignee: Forced Gas Technologies, LLC, Greenville, SC (US)

( * ) Notice: Subject to any disclaimer, the term of this patent is extended or adjusted under 35 U.S.C. 154(b) by 766 days.

(21) Appl. No.: 12/291,784

(22) Filed: Nov. 13, 2008

(65) Prior Publication Data

US 2010/0116512 A1 May 13, 2010

(51) Int. Cl.
*A62C 5/02* (2006.01)

(52) U.S. Cl. ..... 239/8; 239/432; 239/434; 239/590; 239/433; 169/14

(58) Field of Classification Search ..... 239/433, 239/432, 434, 590, 8; 169/14, 15
See application file for complete search history.

(56) References Cited

U.S. PATENT DOCUMENTS

| | | | | | |
|---|---|---|---|---|---|
| 2,106,043 | A | | 1/1938 | Urquhart et al. | 261/76 |
| 2,423,618 | A | | 7/1947 | Ratzer | 261/116 |
| 3,701,482 | A | * | 10/1972 | Sachnik | 239/590.3 |
| 3,836,076 | A | | 9/1974 | Conrad et al. | 239/8 |
| 4,330,086 | A | | 5/1982 | Nysted | 239/8 |
| 4,802,630 | A | * | 2/1989 | Kromrey et al. | 239/428 |
| 5,054,688 | A | | 10/1991 | Grindley | 239/407 |
| 5,058,809 | A | | 10/1991 | Carroll et al. | 239/428.5 |
| 5,113,945 | A | | 5/1992 | Cable | 169/15 |
| 5,133,500 | A | * | 7/1992 | Simpson | 239/150 |
| 5,645,223 | A | * | 7/1997 | Hull et al. | 239/428.5 |
| 5,881,817 | A | | 3/1999 | Mahrt | 169/15 |
| 6,042,089 | A | | 3/2000 | Klein | 261/76 |
| 6,089,324 | A | | 7/2000 | Mahrt | 169/15 |
| 6,112,819 | A | * | 9/2000 | Henry | 169/15 |
| 6,889,773 | B2 | * | 5/2005 | Hanratty | 169/14 |

OTHER PUBLICATIONS

International Search Report for International Application No. PCT/US2009/005349, pp. 1-2.

* cited by examiner

*Primary Examiner* — Dinh Q Nguyen
(74) *Attorney, Agent, or Firm* — McNair Law Firm, P.A.; Douglas W. Kim

(57) ABSTRACT

A fire suppression apparatus and method of generating foam are provided in which a foam-forming liquid is introduced under high velocity and pressure into a mixing manifold through a plurality of jets, and a non-combustible gas is introduced under high velocity and pressure into the center of the mixing manifold, downstream of the jets and in the direction of flow of the foam-forming liquid. The foam generated in the mixing manifold is discharged through a hose and nozzle connected to the mixing manifold. The apparatus may be a self-contained unit, supported on a frame, with its own supply of foam-forming liquid and non-combustible gas.

26 Claims, 3 Drawing Sheets

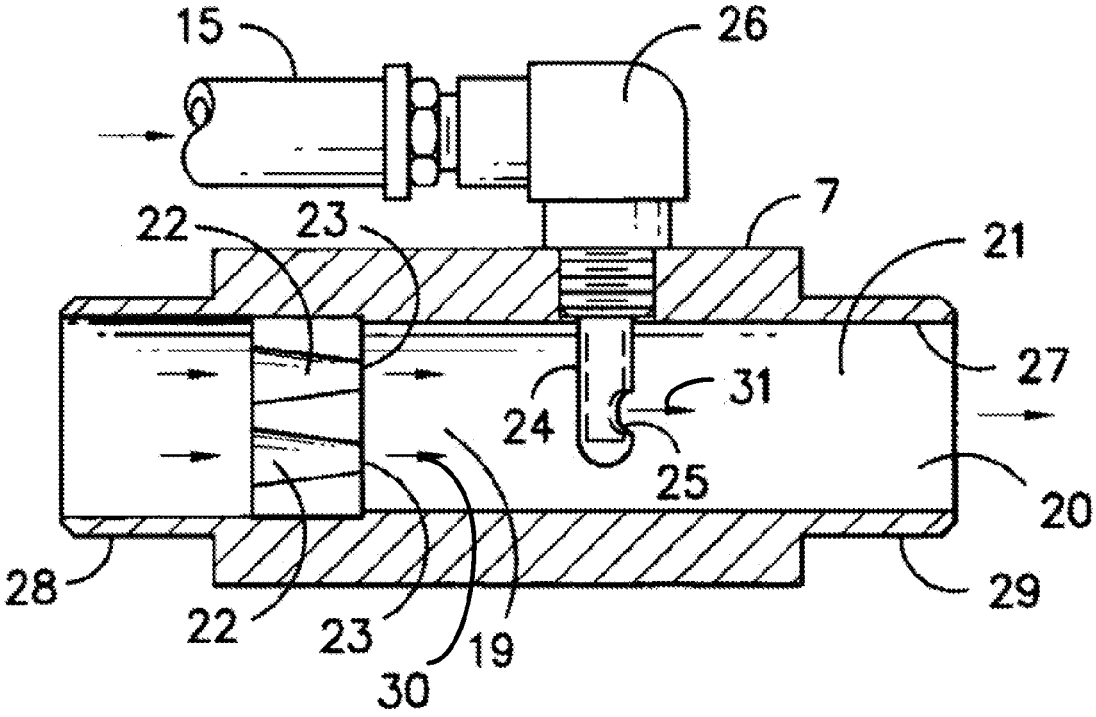
FIG. —5—

FIRE SUPPRESSION APPARATUS AND METHOD FOR GENERATING FOAM

BACKGROUND OF THE INVENTION

This invention is directed to a portable, fire suppression system, wherein a foamable liquid and a non-flammable compressed gas are combined in a manifold to generate foam.

It is well known that the application of foam is useful to suppress fires. The foam is generated at the site of the fire, typically by mixing together a stream of water containing a suitable foaming agent and air. The quality of the foam, the liquid to gas ratio of the foam, the ability to use non-combustible gases, and the distance that the foam can be sprayed are factors relevant to the design and operation of fire suppression equipment.

Carroll et al., U.S. Pat. No. 5,058,809 is representative of a foam generating nozzle designed to aspirate ambient air into a flowing aqueous stream containing a foam producing agent. Foam is produced and discharged from the outlet of the nozzle. It is also known to incorporate a deflection or impingement structure in a foam-generating nozzle to facilitate mixing and increase foam production, as shown in Nysted, U.S. Pat. No. 4,330,086.

There are a number of drawbacks associated with foam generating nozzles. Since air contains oxygen, foam generated from using air as the gas is not ideal for smothering a fire. Also, many of the nozzles operate as ejectors, that is, the kinetic energy of the flowing aqueous stream is used to draw air into the nozzle. The principle of conservation of momentum results in a decrease in the velocity of the aqueous stream. Furthermore, deflection and impingement structures provided in the nozzle can increase the resistance to fluid flow through the nozzle.

Urquhart et al., U.S. Pat. No. 2,106,043 disclose a method for generating foam in which a non-combustible gas is mixed with an aqueous foam forming mixture in a foam forming chamber. The entering gas is distributed in the foam forming chamber under pressure, wherein the pressure of the gas is sufficient to carry the foam from the chamber through the hose and nozzle attached thereto. The gas is introduced perpendicular to the flow of the aqueous mixture.

Foam-generating devices having a mixing manifold, in which the gas is injected at an angle of less than 90° relative to the flow direction of the foam forming liquid solution, are disclosed in Mahrt, U.S. Pat. No. 5,881,817 and Henry, U.S. Pat. No. 6,112,819. Neither of the aforementioned references, however, contains jets or other means to increase the velocity of the foam-forming liquid, prior to the foam-forming liquid making contact with the gas being injected into the mixing manifold.

SUMMARY OF THE INVENTION

The present invention is directed to an apparatus and method for generating foam, which may be used to suppress a fire. The apparatus includes a source of a foam-forming liquid and a gas, both of which are introduced under pressure into a mixing manifold. Foam is generated in the mixing manifold, flows through a hose and is discharged from a nozzle. The apparatus may be mounted on a cart or on a self-propelled vehicle, such as a truck, or may be stationary, such as installed in a structure.

The foam-forming liquid may be pre-mixed and stored in a tank. Alternatively, a foam-forming agent may be metered into a bulk liquid, in a blend-on-the-fly operation, if desired. The foam-forming liquid is introduced into the mixing manifold under pressure, for example, by pressurizing the tank in which the liquid is stored or by pumping the liquid. A valve may be provided in the line delivering the liquid to the manifold, to control the rate of flow of the liquid, thereby allowing an operator to control the liquid-to-gas ratio of the foam generated. By way of example, the liquid-to-gas ratio may be range from 1:15 to 1:50, preferably 1:20 to 1:40.

The gas may be compressed and stored in a tank, under pressure. A regulator is provided, to reduce the pressure of the gas stored in the tank to a desired operating pressure, prior to introducing the gas to the mixing manifold. The compressed gas may also be employed to pressurize the liquid storage tank. For example, the gas line exiting the regulator may be branched, with one line employed for conveying the gas to the mixing manifold and the other line employed to pressurize the liquid storage tank. In such an example, the foam-forming liquid flowing to the manifold and the gas flowing to the manifold will be under approximately the same pressure.

In one embodiment of the invention, the gas is a non-flammable gas. Examples of suitable non-flammable gases include nitrogen, carbon dioxide, halocarbons, noble gases, and gases containing an insufficient concentration of oxygen to support combustion.

The foam-forming liquid is sprayed into the inlet of a mixing manifold through at least one jet. The jet has a discharge nozzle having a cross-sectional area that is less than the cross-sectional area of the cavity of the mixing manifold. In one embodiment, the foam-forming liquid is injected into the mixing manifold through a plurality of jets. For example, from three to seven jets may be employed. The jets may be "free jets," defined as a jet having a nozzle cross-sectional area that is less than ⅕ the cross-sectional area of the cavity of the mixing manifold, into which the jet is sprayed. While it is believed that a jet having a nozzle configuration, that is, an inlet tapering to a narrower discharge opening, creates a turbulent, high velocity cone of foam-forming liquid, which enhances foam creation in the mixing manifold, the jet may also be created by a hole or slot in an orifice plate.

In one embodiment of the invention, the velocity of the liquid exiting the jet nozzles is at least 10 feet per second at a flow rate of 10 gallons per minute, preferably at least 15 feet per second, at a flow rate of 10 gallons per minute.

The jet(s) are directed toward the outlet of the mixing manifold. It is believed to be advantageous to design the jet(s) to create a spray pattern that fills at least 50%, preferably at least 75%, most preferably substantially all of the cross-sectional area of the cavity of the mixing manifold.

The gas is introduced under pressure into the cavity of the mixing manifold, at an angle of less than 90° relative to the direction of the flow of the foam-forming liquid through the manifold, referred to herein as in the downstream direction relative to the flow of the foam-forming liquid. In one embodiment, the gas is introduced at an angle of 60° or less, preferably 45° or less relative to the direction of the flow of the foam-forming liquid. The gas is introduced in sufficient quantity and velocity to generate foam flowing through the outlet of the manifold, when the gas mixes with the foam-forming liquid.

The gas may be introduced at a location downstream of the discharge nozzle of the jet(s). The point of introduction of the gas into the mixing manifold may be selected to coincide with the location of the spray pattern of the jet(s) filling at least 50%, preferably at least 75%, most preferably substantially all of the cross-sectional area of the mixing manifold. In one embodiment, the point of introduction of the gas is at a distance of from 2 to 18 nozzle diameters from the discharge nozzle of the jet(s), preferably 3 to 12 nozzle diameters from the discharge nozzle of the jet(s).

An object of the present invention is minimize the loss of momentum of the liquid, gas and foam, resulting from the angle of introduction of the gas, relative to the flow of liquid through the mixing manifold. Various means may be employed to accomplish the objective, including introducing the gas through a port located in the side of the mixing manifold at a downstream angle, through a cross-bar having an aperture facing downstream, or through a tube inserted substantially in the center of the flow of the liquid through the mixing manifold.

It is believed that the momentum of the fluids is best conserved when the gas is introduced into the mixing manifold at substantially the same angle as the direction of flow of the foam-forming liquid through the mixing manifold. Additionally, improvements in performance are realized when the gas is introduced into a location that is within ½ radius from the center of the cavity of the mixing manifold, wherein the radius is that of the cavity at the point of introduction of the gas, measured perpendicular to the flow of the liquid. In one embodiment, the gas is introduced at substantially in the center of the flow of the liquid through the mixing manifold, with an aperture facing downstream, such as through a tube fashioned in the shape suggesting a "periscope."

The pressure at which the foam-forming liquid is discharged from the jet nozzles into the mixing manifold and the pressure at which the gas is discharged into the mixing manifold may be substantially the same, to avoid a damming effect, which may cause uneven flow rates. It can be understood by those skilled in the art that the pressure drops experienced by the foam-forming liquid and the gas may be different, and the liquid and gas may be delivered to the jets and the mixing manifold respectively at different pressures, so that the discharge pressure of the liquid from the jets and the discharge pressure of the gas into the cavity of the mixing manifold are balanced. For example, two regulators may be employed to reduce the pressure of the gas in the gas storage tank, which allows for pressurizing the liquid storage tank at a first pressure and pressurizing the gas delivered to the mixing manifold to a second pressure. Alternatively, the apparatus may be designed so that the pressure drop experienced by each of the liquid and the gas flowing from storage into the mixing manifold is approximately the same.

The mixing manifold has an inlet, a cavity, an outlet, as well as means to introduce the gas into the cavity of the mixing manifold. In one embodiment of the invention, the mixing manifold has a "flow through" design, characterized by (i) a cavity that is substantially straight between the inlet and outlet, that is, it is substantially free from bends and curves, and (ii) the outlet is at the downstream end of the cavity, that is, the outlet does not project into the cavity to cause recirculation of the liquid, gas or foam. By way of example, the mixing manifold may have a cylindrical cavity, with an inside diameter of from 1 to 2 inches. In one embodiment of the invention, the diameter of the mixing manifold from the point at which the gas is introduced to the outlet of the mixing manifold is substantially the same, thereby avoiding destabilizing shear, which can cause rupture or collapse of the foam.

One end of a hose is connected to the outlet of the mixing manifold. A conventional fire hose may be employed. A nozzle is connected to the opposite end of the hose, for directing and controlling the flow of foam from the apparatus.

By selecting from and combining the aforementioned features, it is possible to dramatically increase the velocity of the foam-forming liquid introduced into the mixing manifold, to position the jet(s) to direct a high-velocity cone of the foam-forming liquid into close proximity to the point of introduction of the gas into the mixing manifold, and to create a spray pattern of the foam-forming liquid that maximizes entrainment of the gas. Furthermore, it is possible to introduce the gas into the cavity of the mixing manifold at a location to enhance uniform dispersion, and in a direction to minimize the loss of momentum of the fluids. The turbulence and momentum created in the mixing manifold results in high-quality foam being formed, which is propelled along the length of hose and expelled from the nozzle at a high-velocity.

BRIEF DESCRIPTION OF THE DRAWINGS

FIG. 5 is a cross-sectional view of the mixing manifold, taken along line 5-5 shown in FIG. 3.

DETAILED DESCRIPTION OF THE INVENTION

Without limiting the scope of the invention, the preferred embodiments and features are hereinafter set forth. All United States patents cited in the specification are incorporated by reference. Unless otherwise indicated, the conditions are 25° C., 1 atmosphere of pressure, 50% relative humidity, and the percentage of materials in compositions are by weight. Nozzle diameters for non-circular nozzles, such as slots, are calculated across the shorter dimension. In the case of multiple nozzles having non-uniform nozzle diameters, an average nozzle diameter is calculated using an area weighting, that is, each nozzle diameter measurement is weighted by the area at the discharge point of the nozzle.

Figure 1:
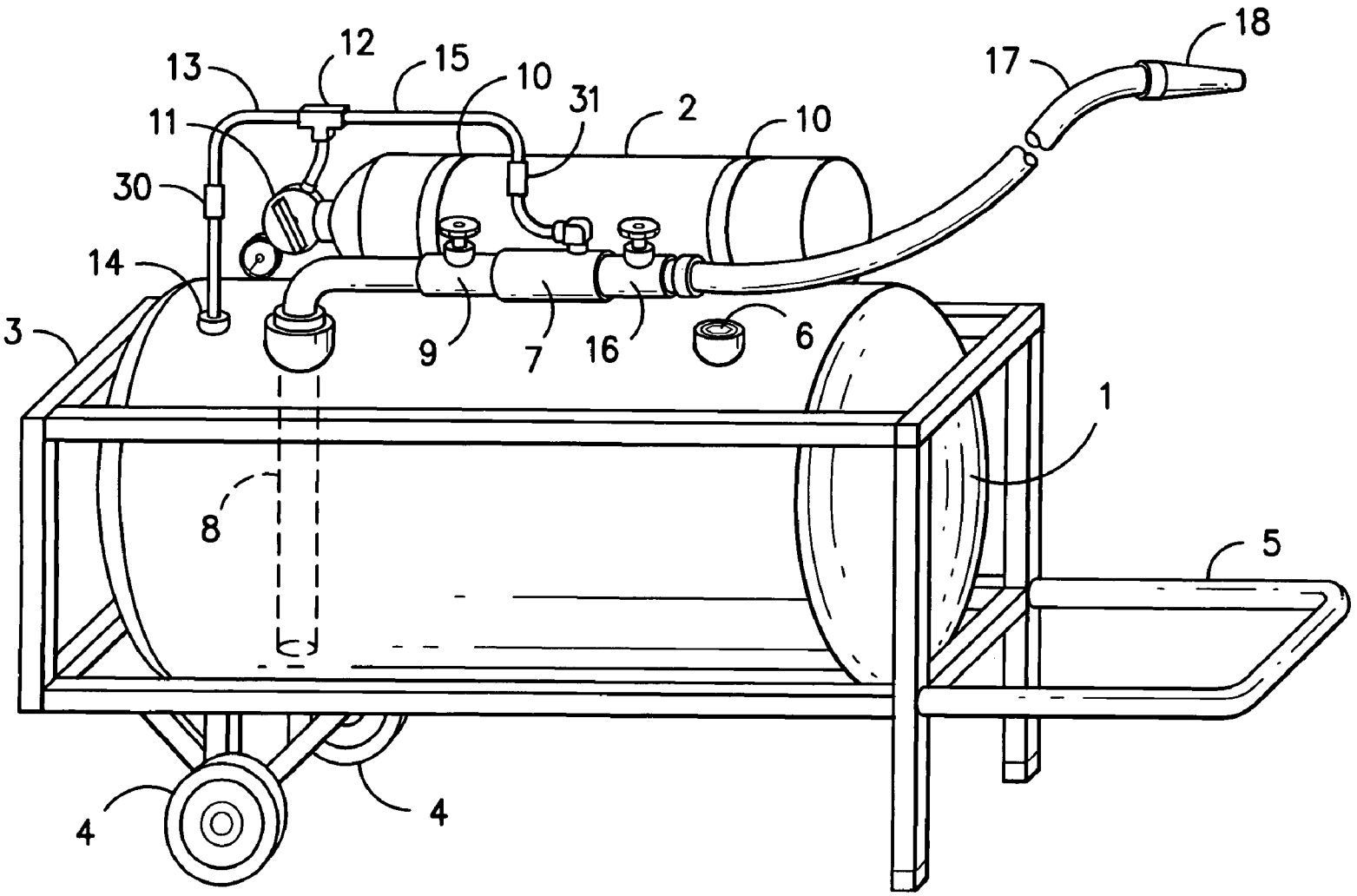
FIG. 1 is perspective view of the fire suppression apparatus.

Referring to FIG. 1, the fire suppression apparatus has liquid tank 1 and compressed gas tank 2, which are mounted on frame 3. Frame 3 includes wheels 4 and handle 5, for manual transport of the apparatus to the scene of a fire. It is also within the scope of the invention for the fire suppression apparatus to be mounted on a vehicle for transport, such as on the bed of a truck, or for the fire suppression apparatus to be designed as a stationary unit, such as may be provided in a hotel or restaurant. Also within the scope of the invention is a scaled-down version of the apparatus, which can be mounted on a pack frame and carried by an individual to the scene of a fire.

Liquid tank 1 contains a foam-forming liquid for suppressing a fire. Liquid tank 1 is provided with fill cap 6, for adding liquid. By way of example, the foam-forming liquid may be an aqueous solution of water and a foam-forming agent, such as Fire-Trol Class A liquid foaming agent, soaps and detergents In an alternative embodiment (not shown), the foam-forming agent may be provided in a separate tank mounted on frame 3, whereby the foam-forming agent may be mixed with a liquid, on-the-fly, for example, by metering the foam-forming agent into a liquid, such as water, as the liquid is delivered from a storage tank to the mixing manifold.

Liquid from liquid tank 1 is introduced under pressure to mixing manifold 7. As illustrated in FIG. 1, pressure in liquid tank 1 forces the liquid up dip-leg 8, through foam control valve 9, to mixing manifold 7. Foam control valve 9 is used to adjust the flow rate of the liquid, which affects the ratio of liquid to gas in the foam produced in mixing manifold 7. For safety purposes, the degree to which foam control valve 9 can be opened and closed may be restricted, so that the flow of liquid to the mixing manifold may not be increased beyond a maximum rate nor reduced below a minimum rate. By way of example, the apparatus is designed to create a liquid flow rate of from about 1 to 30 gallons per minute.

Gas tank 2 may be mounted on frame 3 with metal straps 10, or other suitable support. The gas is compressed, typically up to about 3,000 pounds per square inch gauge (psig). Regulator 11 is provided on the outlet of gas tank 2 for reducing the pressure inside the tank to a workable pressure. For example, regulator 11 may be adjusted to reduce the pressure of the gas to about 90 to 125 psig. The gas leaving regulator 11 is split at tee 12, with line 13 connected to liquid tank 1, at fitting 14. The gas from gas tank 2 builds up in the void above the liquid, thereby providing the pressure to drive the liquid up dip-leg 8. The other branch of tee 12 is line 15, which is connected to mixing manifold 7, for introducing the gas therein. Thus, it can be seen that the liquid from tank 1 and the gas from tank 2 can be delivered to mixing manifold 7 at approximately the same pressure.

Those skilled in the art will recognize that other means may be employed to deliver a foam-forming liquid from tank 1 to mixing manifold 7, under pressure. For example, liquid tank 1 may be pressurized at a higher pressure than the pressure at which gas is delivered to mixing manifold 7, for example, by using two separate regulators (not shown). In another embodiment, liquid from tank 1 is gravity fed to a pump (not shown), which pumps the liquid under pressure to mixing manifold 7. In yet another embodiment of the invention, a second gas tank and second regulator may be provided as back-up for the system.

The foam produced in mixing manifold 7 is conveyed through shut-off valve 16, hose 17 and nozzle 18. The length of hose 17 is selected to provide the firefighter with maneuverability and access to a fire, without unnecessarily reducing the velocity of the foam produced in mixing manifold 7. By way of example, hose 17 is a flexible, canvas covered hose having an inside diameter of from 1 to 2 inches. Hoses having a length of from 25 to 100 feet have been found to be useful herein. Nozzle 18 may be an adjustable nozzle, for controlling the spray pattern and flow rate of the foam.

Those skilled in the art are able to select suitable materials and designs for liquid tank 1, gas tank 2, frame 3 and the piping, to accommodate the compositions, pressures and flow rates of the apparatus. For example, the apparatus may be provided with check valves 30 and 31, in lines 13 and 15, respectively, as shown in FIG. 1.

Figure 2:
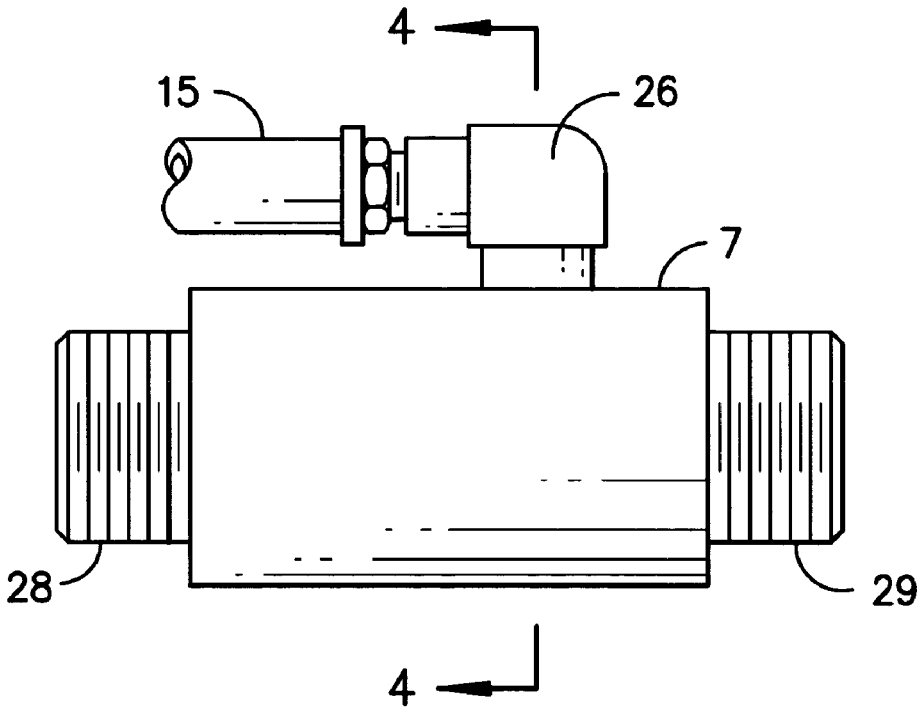
FIG. 2 is a side view of the mixing manifold.

FIG. 2 shows a side view of mixing manifold 7. Gas flows into mixing manifold 7 through line 15 and coupling 26. Mixing manifold 7 has threaded ends 28 and 29, for connecting mixing manifold 7 to valves 9 and 16, respectively.

Figure 3:
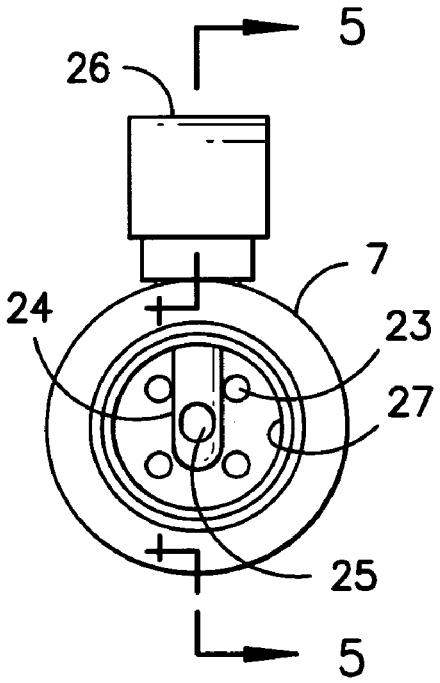
FIG. 3 is an end view of the mixing manifold, taken from the outlet side.

FIG. 3 is an end view of the outlet of mixing manifold 7, showing the spatial arrangement of the discharge nozzles 23 of the four jets discharging the foam-forming liquid. The gas is introduced into the mixing manifold through tube 24, which is connected to coupling 26. The gas is introduced substantially in the center of mixing manifold 7, through outlet 25 in tube 24, and in substantially the same direction as the flow of the liquid. Mixing manifold 7 has internal side walls 27. The use of four jets is shown. Good results have been obtained with from three to five jets, as well.

Figure 4:
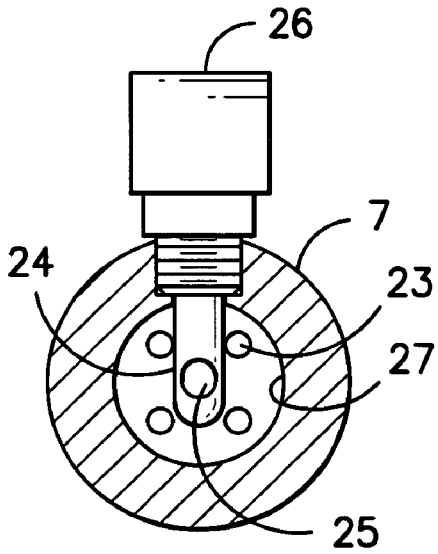
FIG. 4 is a cross-sectional view of the mixing manifold, taken along line 4-4 shown in FIG. 2.

FIG. 4 is a cross-sectional view of mixing manifold 7 showing the components described above, with regard to FIG. 3.

Referring to FIG. 5, mixing manifold 7 has inlet 19, outlet 20 and cavity 21. The foam-forming liquid is injected into cavity 21 through jets 22. Each of jets 22 has a discharge nozzle 23 directed toward outlet 20 and co-current with the flow of liquid through mixing manifold 7. The foam-forming liquid is injected into the cavity in a foam-forming liquid travel path shown as 30 in FIG. 5. The inlet of the jets is about ½ inch in diameter and the discharge nozzle 23 of the jets is about ¼ inch in diameter. It is also within the scope of the invention to provide jets of various lengths and with various discharge diameters, for example, to maximize the velocity, turbulence and mixing at the point of contact between the liquid and the gas.

Gas is introduced into cavity 21 through tube 24 having opening 25. Opening 25 in tube 24 is positioned in approximately the center of the flow of liquid through cavity 21, that is, relative to the side walls 27 of cavity 21. Gas is introduced into cavity 21 having a flow direction shown as 31. In one embodiment, the angle between the gas flow direction is 60° or less relative to the foam-forming liquid travel path. In one embodiment, the gas flow direction is parallel with the foam-forming liquid travel path. Tube 24 and opening 25 may be provided with a design suggesting a "periscope", that is, with an elbow pointed toward outlet 20, to minimize the loss of downstream momentum of the gas. Cavity 21 of mixing manifold 7 has an inside diameter of 1 inch and a length of 3 inches. In the embodiment of the invention shown, outlet 20 of cavity 21, shut-off valve 16 and hose 17 have an inside diameter approximately the same as cavity 21, thereby minimizing shearing and a reduction in the velocity of the foam.

Opening 25 of tube 24 is located downstream from discharge nozzles 23 of jets 22. In the embodiment shown in FIGS. 5, opening 25 is located approximately 9 nozzle diameters downstream from the outlet of discharge nozzles 23. The outer edge of discharge nozzles 23 are positioned approximately ⅛ to ¼ inch from side walls 27 of cavity 21. Using a spray angle of 14°, it is estimated that the spray pattern of jets 22 substantially fills cavity 21 at the point of introduction of the gas through tube 24. The discharge nozzles 23 are positioned to direct a high-velocity cone of the foam-forming liquid adjacent the discharge of gas through opening 25, while creating a spray pattern that maximizes entrainment of the gas in cavity 21.

In alternative embodiments of the invention (not shown), the gas may be introduced into cavity 21 of mixing chamber 7 through a port in the side of the mixing manifold, as shown in U.S. Pat. No. 5,881,817, or through a cross-bar positioned in the mixing chamber, as shown in U.S. Pat. No. 6,112,819, provided that the gas is introduced downstream, relative to the flow of the liquid.

There are, of course, many alternative embodiments of the invention intended to be included in the scope of the following claims.

What I claim is:

1. A method of generating a foam, comprising the steps of: introducing a pressurized foam-forming liquid into a cavity in a mixing manifold, through a jet nozzle positioned in the inlet of the mixing manifold; introducing a pressurized gas into a cavity in the mixing manifold, wherein the gas is directed downstream at an angle of 60° or less, relative to the direction of flow of liquid through the manifold; generating a foam in the mixing manifold; and allowing the foam to flow from an outlet in the mixing chamber to a hose connected to a nozzle.

2. The method of claim 1, wherein the gas is introduced at a location downstream from the jet nozzle and at an angle of 45° or less, relative to the direction of the flow of the liquid through the mixing manifold.

3. The method of claim 1, wherein the pressurized foam-forming liquid is introduced into the inlet of the mixing manifold through a plurality of jet nozzles, and the jets are free jets.

4. The method of claim 3, wherein the jets are arranged to provide a spray pattern that substantially fills the cavity in the mixing chamber at the location where the gas is introduced, and wherein the gas is introduced at an angle of 45° or less, relative to the direction of the flow of the liquid through the mixing manifold.

5. The method of claim 4, wherein the discharge velocity of the foam-forming liquid from the jet nozzles is 10 feet per second or greater at a liquid flow rate of 10 gallons per minute.

6. The method of claim 4, wherein the mixing manifold is cylindrical and has an inside diameter of from 1 to 2 inches.

7. The method of claim 1, wherein the foam-forming liquid is introduced into the cavity of the mixing manifold through from 3 to 7 jets, wherein the jets are free jets, and wherein the gas is introduced at a location of from 3 to 18 nozzle diameters downstream from the jets, at substantially the same angle as the direction of the flow of the liquid through the mixing manifold.

8. The method of claim 7, wherein the liquid and gas are pressurized to substantially the same pressure.

9. The method of claim 7, wherein the gas is selected from the group consisting of nitrogen and carbon dioxide.

10. The method of generating a foam, comprising the steps of: introducing a pressurized foam-forming liquid into a cavity in a mixing manifold, through a jet nozzle positioned in the inlet of the mixing manifold; introducing a pressurized gas into a cavity in the mixing manifold, at a position downstream from the jet nozzle, wherein in the gas is introduced into the cavity at a position within ½ radius from the center of the cavity; generating a foam in the mixing manifold; and allowing the foam to flow from an outlet in the mixing chamber to a hose connected to a nozzle.

11. The method of claim 10, wherein the pressurized foam-forming liquid is introduced into the inlet of the mixing manifold through a plurality of jet nozzles, and the jets are free jets.

12. The method of claim 10, wherein the foam-forming liquid is introduced into the cavity of the mixing manifold through from 3 to 7 jets, wherein the jets are free jets, and wherein the gas is introduced at a location of from 3 to 18 nozzle diameters downstream from the jets, at substantially the same angle as the direction of the flow of the liquid through the mixing manifold.

13. The method of claim 12, wherein the mixing manifold is cylindrical and has an inside diameter of from 1 to 2 inches, and the mixing manifold is characterized by a flow through design.

14. The method of claim 11, wherein the liquid and gas are pressurized to substantially the same pressure and the gas is selected from the group consisting of nitrogen and carbon dioxide

15. A foam generating apparatus comprising: a mixing manifold having an internal cavity, an inlet and an outlet, wherein the outlet is at an opposite end of the cavity from the inlet; a plurality of jets for spraying a pressurized, foam-forming liquid into the inlet of the manifold, wherein the jets are directed toward the outlet of the mixing manifold; means to deliver the foam-forming liquid under pressure to the jets; means for introducing a pressurized gas into the cavity of the manifold, downstream of the jet, and in sufficient quantity and velocity to generate a foam flowing through the outlet of the manifold, wherein the gas is directed downstream, relative to the direction of flow of liquid through the manifold; a hose having a first end connected to the outlet of the manifold and a second end; and a nozzle connected to the second end of the hose.

16. The apparatus of claim 15, wherein in the gas is introduced into the cavity at a position within ½ radius from the center of the cavity.

17. The apparatus of claim 16, wherein the foam-forming liquid is introduced into the cavity of the mixing manifold through from 3 to 7 jets, and wherein the gas is introduced at substantially the same angle as the direction of the flow of the liquid through the mixing manifold.

18. The apparatus of claim 17, wherein the gas is introduced at a location of from 3 to 12 nozzle diameters downstream from the jets.

19. The apparatus of claim 17, wherein the foam-forming liquid comprises water and a foaming agent, and the gas is a nonflammable.

20. The apparatus of claim 17, wherein the mixing manifold is a cylindrical and has an inside diameter of from 1 to 2 inches, and the mixing manifold is characterized by a flow through design.

21. The apparatus of claim 17, further comprising a valve located upstream from the jet for spraying a pressurized, foam-forming liquid into the inlet of the manifold, for controlling the flow of the foam-forming liquid to the manifold, thereby adjusting the liquid to gas ratio in the mixing manifold.

22. A foam generating apparatus comprising: a liquid tank for a pressurized foamable liquid; a gas tank for a pressurized gas; a manifold fluidly connected to the liquid and gas tank, having an internal cavity, an inlet and an outlet, wherein the outlet is at an opposite end of the cavity from the inlet; a plurality of jets for spraying a pressurized, foamable liquid into the inlet of the manifold, wherein the liquid is sprayed in a direction toward the outlet of the manifold; a means to introduce a pressurized gas into the cavity of the manifold, downstream of the jets and into the liquid spray, in sufficient quantity and velocity to generate a foam flowing through the outlet of the manifold, wherein in the gas is introduced into the cavity at a position within ½ radius from the center of the cavity; and a hose connected to the outlet of the manifold, capable of conveying the foam.

23. The foam generating apparatus of claim 22, wherein the foam-forming liquid is introduced into the cavity of the mixing manifold through from 3 to 7 jets, and wherein the gas is introduced at substantially the same angle as the direction of the flow of the liquid through the mixing manifold.

24. The foam generating apparatus of claim 23, wherein the gas is introduced at a location of from 3 to 18 nozzle diameters downstream from the jets.

25. The foam generating apparatus of claim 22, wherein the gas is introduced at a location of from 3 to 12 nozzle diameters downstream from the jets.

26. The foam generating apparatus of claim 10, including a container having a foam-forming liquid that is introduced in said mixing manifold through a jet nozzle positioned in the inlet of the mixing manifold.

* * * * *